US006904728B2

(12) United States Patent
Stutts

(10) Patent No.: US 6,904,728 B2
(45) Date of Patent: Jun. 14, 2005

(54) LOG HOME CONSTRUCTION SYSTEM

(75) Inventor: H. Craig Stutts, Loudon, TN (US)

(73) Assignee: Heritage Log Homes, Inc., Sevierville, TN (US)

( * ) Notice: Subject to any disclaimer, the term of this patent is extended or adjusted under 35 U.S.C. 154(b) by 0 days.

(21) Appl. No.: 10/341,784

(22) Filed: Jan. 14, 2003

(65) Prior Publication Data

US 2004/0134142 A1 Jul. 15, 2004

(51) Int. Cl.[7] ..... E04B 1/10

(52) U.S. Cl. ..... 52/233; 52/223.7; 52/223.13; 52/223.14

(58) Field of Search ..... 411/222, 230, 411/238; 52/233, 223.5, 223.7, 272, 223.13, 223.14

(56) References Cited

U.S. PATENT DOCUMENTS

| | | | | |
|---|---|---|---|---|
| 4,248,285 A | * | 2/1981 | Flaig | 411/246 |
| 4,688,362 A | * | 8/1987 | Pedersen et al. | 52/223.7 |
| 4,832,528 A | | 5/1989 | Lisart | |
| 4,909,012 A | | 3/1990 | Thompson, Jr. et al. | |
| 5,081,811 A | | 1/1992 | Sasaki | |
| 5,253,458 A | * | 10/1993 | Christian | 52/233 |
| 5,535,561 A | * | 7/1996 | Schuyler | 52/223.13 |
| 5,553,906 A | * | 9/1996 | Kunz | 296/29 |
| 5,787,675 A | | 8/1998 | Futagi | |
| 6,023,895 A | * | 2/2000 | Anderson | 52/233 |
| 6,050,765 A | * | 4/2000 | McGovern et al. | 411/387.2 |
| 6,195,949 B1 | * | 3/2001 | Schuyler | 52/223.13 |
| 6,266,934 B1 | | 7/2001 | Houseal | |
| 6,363,672 B1 | | 4/2002 | Baker | |
| 6,385,929 B1 | * | 5/2002 | Englehart | 52/233 |
| 6,557,316 B2 | * | 5/2003 | Van Der Heijden | 52/585.1 |
| 2002/0046519 A1 | | 4/2002 | Houseal | |
| 2002/0121055 A1 | | 9/2002 | Englehart | |

FOREIGN PATENT DOCUMENTS

| | | |
|---|---|---|
| JP | 200022 | 8/2000 |
| JP | 200206 | 2/2002 |

OTHER PUBLICATIONS

Five Sheets of Engineering Drawings from Lodge Logs.

* cited by examiner

*Primary Examiner*—Anita King
*Assistant Examiner*—Amy J. Sterling
(74) *Attorney, Agent, or Firm*—Luedeka, Neely & Graham, P.C.

(57) ABSTRACT

A wall includes a plurality of wall members stacked substantially vertically and including a bottom wall member and a top wall member. Each wall member has an upper surface in opposed relation to a lower surface and a through opening extending from the upper surface to the lower surface. A through opening in each wall member is aligned with a through opening in all other wall members so as to form a through opening in the wall extending from the upper surface of the top wall member to the lower surface of the bottom wall member. A rod, having an upper end in opposed relation to a lower end, is positioned in the through opening of the wall and a lower fastener attaches to the lower end of the rod adjacent the lower surface of the bottom wall member. An upper fastener attaches to the upper end of the rod adjacent the upper surface of the top wall member, and an actuator is positioned between the upper fastener and the upper surface of the top wall member for applying a downward force to the top wall member.

11 Claims, 5 Drawing Sheets

LOG HOME CONSTRUCTION SYSTEM

BACKGROUND

1. Field of the Invention

The present invention relates generally to structures composed of individual wall members and methods of constructing those structures. More particularly, the present invention relates to log structures and a thru-bolt system for constructing log structures.

2. Background of the Invention

Log structures are constructed for a variety of purposes. The log structures typically are comprised of walls which include individual wall members that shrink or settle over time. The shrinkage or settling must be accommodated to facilitate a proper fit between the wall members. Without accommodation for the settling, the log structure may develop gaps or cracks in the walls. One previous approach has been to periodically tighten a fastener which compresses the wall members, however, this approach creates an undesirable maintenance burden.

Therefore, there is a need for an improved wall and method of constructing a wall which simplifies construction and accommodates shrinkage or settling of the wall members without the need for frequent maintenance.

SUMMARY OF THE INVENTION

The present invention eliminates the difficulties and disadvantages of the prior art by providing a wall for a structure. In one embodiment the wall comprises a plurality of wall members stacked substantially vertically, including a bottom wall member and a top wall member. Each of the wall members have an upper surface in opposed relation to a lower surface, and a through opening extending from the upper surface to the lower surface. A through opening in each wall member is aligned with a through opening in all other wall members so as to form a through opening in the wall extending from the upper surface of the top wall member to the lower surface of the bottom wall member. A rod is positioned in the through opening of the wall, the rod having an upper end in opposed relation to a lower end and the rod extending along a first axis. A lower fastener is attached to the lower end of the rod and attached to the bottom wall member. The lower fastener comprises a locking nut, and the locking nut includes an internally threaded portion for receiving a threaded portion of the lower end of the rod. The threaded portion of the locking nut extends substantially along the first axis. The locking nut also comprises a flange extending transversely to the first axis for supporting the threaded portion. The flange of the locking nut includes a fastening means attaching the flange to the lower surface of the bottom wall member to secure the lower fastener to the bottom wall member. In addition, the threaded portion of the locking nut comprises a tapered surface opening at an end of the threaded portion for receiving the rod to facilitate attachment of the rod to the lower fastener. The wall also includes an upper fastener attached to the upper end of the rod adjacent the upper surface of the top wall member, and an actuator positioned between the upper fastener and the upper surface of the top wall member for applying a downward force to the top wall member.

In a alternate embodiment the wall comprises a plurality of wall members stacked substantially vertically, including a bottom wall member and a top wall member, with each of the wall members including an upper surface in opposed relation to a lower surface and a through opening extending from the upper surface to the lower surface. A through opening in each wall member is aligned with a through opening in all other wall members so as to form a through opening in the wall extending from the upper surface of the top wall member to the lower surface of the bottom wall member. A rod is positioned in the through opening of the wall, the rod having an upper end in opposed relation to a lower end, and the rod extending along a first axis. A lower fastener is attached to the lower end of the rod and attached to the lower surface of the bottom wall member. The lower fastener comprises a locking nut, the locking nut including an internally threaded portion for receiving a threaded portion of the lower end of the rod, and the locking nut further including an unthreaded portion approximately one half inch (1.25 cm) long below the threaded portion. The threaded portion and unthreaded portion of the locking nut extend substantially along the first axis. The locking nut also includes a flange extending transversely to the first axis for supporting the threaded portion, and the flange of the locking nut includes a fastening means attaching the flange to the lower surface of the bottom wall member thereby securing the lower fastener to the bottom wall member. The wall also includes an upper fastener attached to the upper end of the rod adjacent the upper surface of the top wall member. There is an actuator positioned between the upper fastener and the upper surface of the top wall member for applying a downward force to the top wall member.

In a different embodiment, the wall comprises a plurality of wall members stacked substantially vertically, including a bottom wall member and a top wall member. Each of the wall members include an upper surface in opposed relation to a lower surface and a through opening extending from the upper surface to the lower surface. A through opening in each wall member is aligned with a through opening in all other wall members so as to form a through opening in the wall extending from the upper surface of the top wall member to the lower surface of the bottom wall member. A rod is positioned in the through opening of the wall, the rod having an upper end in opposed relation to a lower end, and the rod extending along a first axis. A lower fastener is attached to the lower end of the rod and attached to the lower surface of the bottom wall member. The lower fastener comprises a locking nut and the locking nut includes an internally threaded portion for receiving a threaded portion of the lower end of the rod. The threaded portion of the locking nut extends substantially along the first axis and the locking nut has a tapered surface opening at an end of the threaded portion for receiving the rod to facilitate attachment of the rod to the lower fastener. The locking nut also has a flange extending transversely to the first axis for supporting the threaded portion. The flange of the locking nut includes a fastening means attaching the flange to the lower surface of the bottom wall member to secure the lower fastener to the bottom wall member A spring support plate is attached to the upper surface of the top wall member. The spring support plate has an opening for the rod to pass therethrough and the spring support plate also has at least one hole for at least one spring support plate fastener. At least one the spring support plate fastener passes through a hole in the spring support plate thereby attaching the spring support plate to the top wall member. The wall also includes an upper fastener attached to the upper end of the rod adjacent the upper surface of the top wall member and a spring positioned between the upper fastener and the spring support plate for applying a downward force to the top wall member.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
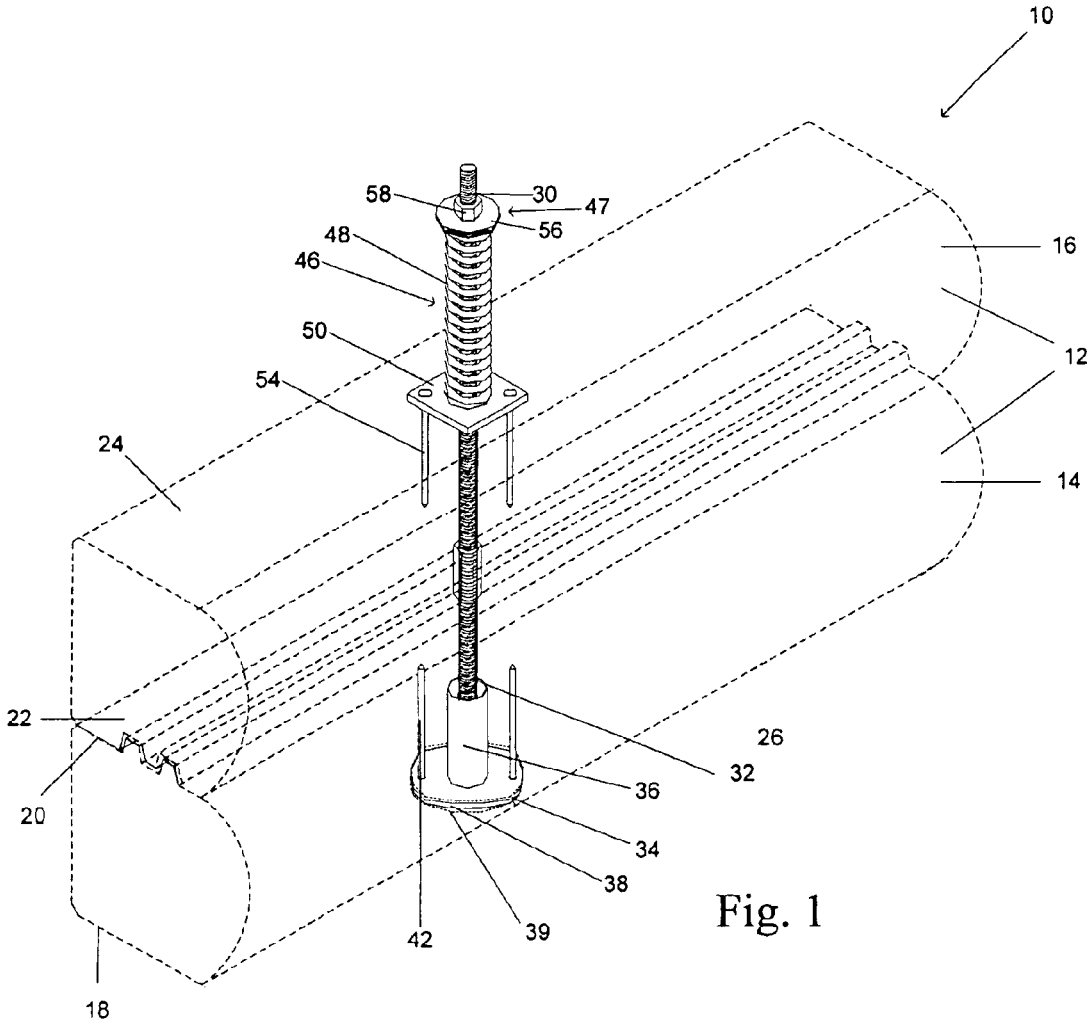
FIG. 1 is a perspective view of a portion of a wall constructed according to one embodiment of the invention.

With reference now to the drawings in which like reference characters designate like or similar parts throughout the several views, FIG. 1 provides a perspective view of a portion of a wall 10 constructed according to the invention. Wall members 12 are preferably stacked substantially vertically. In a particularly preferred embodiment, the wall members 12 comprise wooden logs. The wooden logs may be sawed, cut, formed, or otherwise processed prior to being stacked as part of the wall 10. The wall members 12 can also be formed from other materials such as plastics, resins or other materials suitable for constructing structures. Each wall member 12 includes an upper surface in opposed relation to a lower surface. Preferably, the lower surface of each wall member 12 is substantially parallel to the upper surface of each wall member 12.

The wall members 12 may be of any suitable cross-sectional shape. Such cross-sectional shapes include, but are not limited to, a substantially rectangular shape, a "D" shape (as shown in FIG. 1), or a substantially rounded shape. The height, length, and width of the wall members 12 may be selected by those skilled in the art in accordance with the design requirements of the wall 10.

The wall members 12 include a bottom wall member 14 and a top wall member 16. Although FIG. 1 only depicts the bottom wall member 14 and the top wall member 16, it is understood that the wall 10 can, and typically will, include additional wall members 12 positioned between the bottom wall member 14 and the top wall member 16. The height of wall members 12 and the number of wall members 12 included in the wall 10 control the total height of the wall 10. Therefore, those skilled in the art can achieve a desired wall height by selecting a given wall member 12 size and stacking enough wall members 12 to reach the desired wall height.

The bottom wall member 14 includes a lower surface 18 in opposed relation to an upper surface 20. Preferably, the bottom wall member lower surface 18 is substantially parallel to the bottom wall member upper surface 20. In a preferred embodiment, the bottom wall member lower surface 18 is substantially smooth and the bottom wall member upper surface 20 is notched along the length of the bottom wall member 14. Preferably, the notch along the bottom wall member upper surface 20 is a male notch such that it protrudes above the bottom wall member upper surface 20. In an alternative embodiment, the notch along the bottom wall member upper surface 20 may be a female notch such that it forms a recess within the bottom wall member 14.

The top wall member 16 includes a lower surface 22 in opposed relation to an upper surface 24. The top wall member upper surface 24 is preferably substantially parallel to the top wall member lower surface 22. In a preferred embodiment, the top wall member upper surface 24 is substantially smooth and the top wall member lower surface 22 is notched along the length of top wall member 16. Preferably, the notch along the top wall member lower surface 22 is a female notch and forms a recess within the top wall member 16. Alternatively, the notch along the top wall member lower surface 22 is a male notch and protrudes below the top wall member lower surface 22.

In a preferred embodiment, each wall member 12 is notched along the upper and lower surfaces. In the preferred embodiment, the notches along the upper surfaces of the wall members 12 are male notches and the notches along the lower surfaces of the wall members 12 are female notches. Alternatively, the notches along the upper surfaces of the wall members 12 are female notches and the notches along the lower surfaces of the wall members 12 are male notches. The notches on the upper and lower surfaces of the wall members 12 are of a corresponding cross-sectional shape so that the notches on the upper surfaces of the wall members 12 mate with the notches on the lower surfaces of the wall members 12. The male notches fit within the female notches to help secure the wall members 12 and to provide a tighter fit between the wall members 12.

The wall members 12 include a through opening extending from the upper surface to the lower surface of each wall member 12. In a preferred embodiment, the through opening in each wall member 12 has a substantially round cross-sectional shape. However, other cross-sectional shapes of the through opening in each wall member 12 are also acceptable. Preferably, each wall member 12 contains a plurality of through openings. In a particularly preferred embodiment, the through openings are located at twelve inch intervals along the length of each wall member 12. Preferably, the through openings are drilled or otherwise formed in the wall members 12 prior to the wall members 12 arriving at the site for construction of the wall 10. Alternatively, the wall members 12 are stacked and then the through openings are drilled through the stacked wall members 12.

The bottom wall member 14 and the top wall member 16 also include through openings extending from the bottom wall member upper surface 20 to the bottom wall member lower surface 18 and the top wall member upper surface 24 to the top wall member lower surface 22 respectively. Preferably, a plurality of through openings are formed in the bottom wall member 14 and the top wall member 16 at twelve inch intervals.

As each wall member 12 is stacked, the through openings in the wall members 12 are aligned to create a through opening in the wall 10 extending from the top wall member upper surface 24 to the bottom wall member lower surface 18. In a preferred embodiment wherein through openings are formed in each wall member 12 at twelve inch intervals, the through openings in each wall member 12 align with the through openings in the other wall members 12 such that through openings in the wall 10 are formed at twelve inches intervals.

Figure 2:
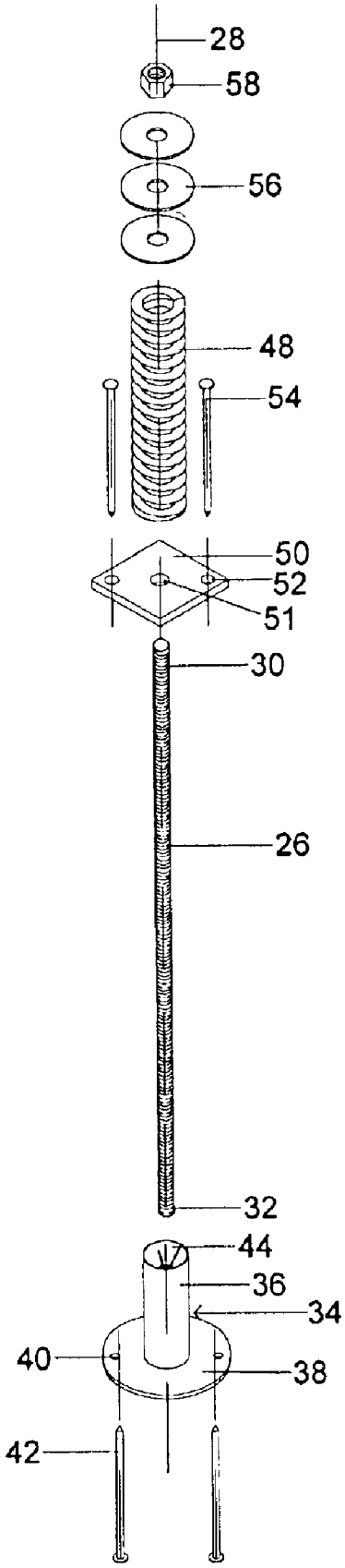
FIG. 2 is an exploded view of a thru-bolt system for constructing walls in accordance with one embodiment of the invention.

After the wall members 12 are stacked with the through openings aligned, a rod 26 is inserted into the through opening in the wall 10. As depicted in FIG. 2, the rod 26 extends along a first axis 28. The rod 26 has an upper end 30 in opposed relation to a lower end 32. Preferably, the rod 26 is threaded along its entire length. In an alternative embodiment, a portion of the rod upper end 30 and a portion of the rod lower end 32 are threaded. In a particularly preferred embodiment, a plurality of the rods 26 are inserted in multiple through openings along the length of the wall 10. Preferably, a rod 26 is inserted in a through opening every three feet which allows wiring or other components to be placed in the through openings which do not contain a rod 26. However, rods 26 may be spaced in any manner along the wall 10 to meet desired design parameters. The length of the rod 26 is preferably sufficient to extend from the bottom wall member lower surface 18 beyond the top wall member upper surface 24 as shown in FIG. 1.

As shown in FIG. 1, a lower fastener 34 is attached at the rod lower end 32. In a preferred embodiment depicted in FIGS. 1 and 2, the lower fastener 34 comprises a locking nut. The locking nut includes an internally threaded portion 36 extending substantially along the first axis 28 and a flange 38 extending substantially transversely to the first axis 28. The flange 38 is fixedly attached to the threaded portion 36. The flange 38 may be fixedly attached to the threaded portion 36 by welding or other suitable means, or the threaded portion 36 and the flange 38 may be formed as a single piece. The flange 38 supports the threaded portion 36. Preferably, the flange 38 has a substantially elliptical shape. In an alternative embodiment, the flange 38 is substantially circular in shape. However, the shape of the flange 38, is not limited to elliptical or circular.

In a preferred embodiment, the lower fastener 34 is attached to the bottom wall member 14. Preferably, the flange 38 includes through apertures 40 which allow flange fasteners 42 to pass through the flange 38 and attach the lower fastener 34 to the bottom wall member 14. Preferably, the flange fasteners 42 comprise nails. In an alternative embodiment, the flange fasteners 42 are screws or bolts. However, the flange fasteners 42 may be any other fastener suitable for attaching the lower fastener 34 to the bottom wall member 14. In another alternative embodiment, the flange 38 does not include through apertures 40 and the lower fastener 34 is attached to the bottom wall member 14 through other fastening means such as adhesives. Alternatively, the lower fastener 34 is not attached to the bottom wall member 14 and may, for example, be held in place by use of a notched fit.

In a particularly preferred embodiment, the flange 38 is countersunk into the bottom wall member 14 such that the flange 38 does not extend substantially beyond the bottom wall member lower surface 18. This embodiment allows the bottom wall member 14 to lay relatively smoothly on a sub-floor or other foundation on which the wall 10 is to be constructed without modification to the sub-floor or foundation. When the flange 38 is countersunk into the bottom wall member 14, a shaped recess 39 is formed in the bottom wall member 14 Preferably, the shape of the shaped recess 39 corresponds to the shape of the flange 38. In a preferred embodiment, the shape of the flange 38 and the corresponding shape of the shaped recess 39 prevent rotation of the lower fastener 34 within the bottom wall member 14. For example, if the flange 38 is elliptical in shape as illustrated in FIG. 1 and the shaped recess is also elliptical in shape, then the shaped recess will prevent the flange 38 and therefore the lower fastener 34 from rotating. Other shapes, including but not limited to rectangular shapes, of the flange 38 and the shaped recess 39 will prevent rotation of the lower fastener 34. Alternatively, if the flange 38 is circular in shape (or of another shape which would permit rotation in the bottom wall member 14) or if additional fastening means are desired, the flanged 38 may include protrusions, such as dimples or spikes) to engage the bottom wall member 14 and prevent rotation of the lower fastener 34.

Preferably, the diameter of the through opening in the wall 10 is large enough to allow the threaded portion 36 of the lower fastener 34 to be inserted into the through opening. In a preferred embodiment in which a rod 26 is placed into a through opening every three feet, a lower fastener 34 is inserted into the corresponding through openings in the bottom wall member 14 every three feet. In alternative embodiments in which the rods 26 are spaced along the wall 10 at different intervals, the lower fasteners 34 are inserted into the corresponding through openings in the bottom wall member 34. Preferably, the lower fasteners 34 are inserted into the appropriate through openings in the bottom wall member 14 prior to the wall members 12 being stacked.

Figure 3:
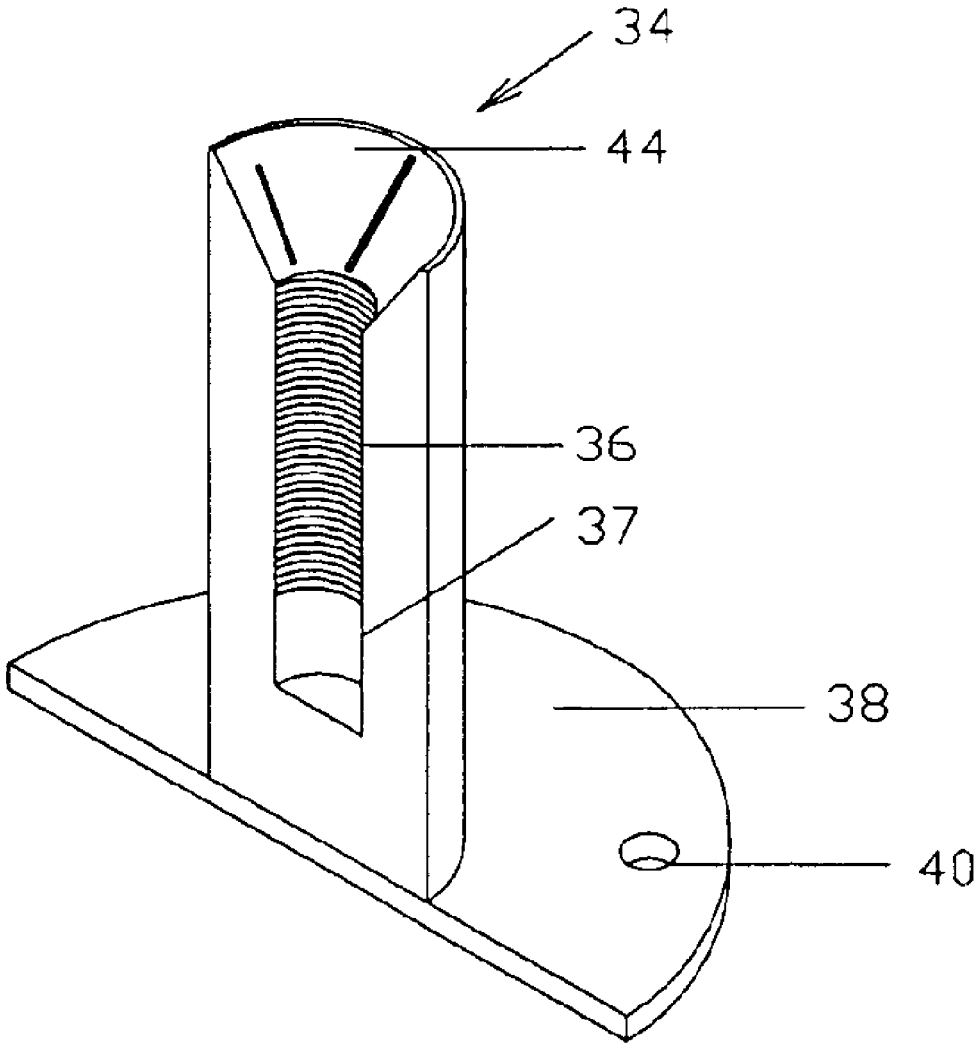
FIG. 3 is a sectional view of a lower fastener according to one embodiment of the invention.

As the rod 26 is inserted into the through opening of the wall 10, the rod 26 is received by the internally threaded portion 36 of the lower fastener 34 and is attached to the lower fastener 34 by rotating the rod 26 about the first axis 28 thereby engaging the threads of the threaded portion 36. With reference to FIG. 3 in a preferred embodiment, the threaded portion 36 includes a tapered surface opening 44. As the rod 26 approaches the threaded portion 36, the rod 26 is guided into the threaded portion 36 by the tapered surface opening 44. The tapered surface opening 44 facilitates attachment of the rod 26 to the lower fastener 34.

In a preferred embodiment, the threaded portion 36 has sufficient length along the first axis 28 to accommodate debris such as wood particles that may enter into the through opening in the wall 10. Thus, the length of the threaded portion 36 is preferably longer than necessary to attach the rod 26 to the lower fastener 34. The additional length allows wood particles or other debris to accumulate within the lower fastener 34 without affecting the ability of the lower fastener 34 to attach to the rod 26. In a preferred embodiment, the length of the threaded portion 36 of the lower fastener 34 is approximately three inches wherein approximately two inches are used to attach the rod 26 to the lower fastener 34 with the extra one inch used for accumulation of wood particles or other debris. Preferably, the threaded portion 36 is threaded for a length sufficient to attach the rod 26 to the lower fastener 34 and the additional length for accumulation of debris need not be threaded as depicted by unthreaded portion 37 on FIG. 3. Alternatively, the entire length of the threaded portion 36 is threaded.

An actuator 46 is positioned between the top wall member upper surface 24 and an upper fastener 47. In a preferred embodiment as depicted in FIGS. 1 and 2, the actuator 46 includes a spring 48 held in compression between the upper fastener 47 and the top wall member 16. Preferably, the actuator 46 also includes a spring support plate 50 positioned between the spring 48 and the top wall member 16. The spring support plate 50 preferably includes a rod hole 51 for allowing the rod 26 to pass through the spring support plate 50. The spring support plate 50 also preferably includes through holes 52 which allow spring support plate fasteners 54 to pass through and attach the spring support plate 50 to the top wall member 16. In a preferred embodiment, the spring support plate fasteners 54 are nails. Alternatively, the spring support plate fasteners 54 are screws or bolts although other fasteners capable of attaching the spring support plate 50 to the top wall member 16 are also acceptable. In another alternative embodiment, the spring support plate 50 is not attached to the top wall member 16. FIGS. 1 and 2 show one embodiment wherein the spring 48 comprises the actuator 46, however other embodiments include a hydraulic cylinder or other suitable actuator capable of applying a downward force to the top wall member 16.

With reference to FIGS. 1 and 2 in a preferred embodiment, the upper fastener 47 includes at least one washer 56 and a nut 58. The washer or washers 56 are placed about the rod 26 above the actuator 46 and the nut 58 is threaded onto the rod 26. In a preferred embodiment, the washers 56 and the nut 58 hold the spring 48 in compression. As the wall members 12 settle or shrink, the spring 48 has sufficient travel to allow a downward force to be maintained to the top wall member 16. Preferably, the length of travel of the spring 48 held in compression is approximately two and one-half inches which accommodates most, if not all, shrinking or settling of the wall members 12. The downward force exerted by the actuator 46 helps ensure a tight, energy efficient fit between the wall members 12 even as the wall members 12 shrink or settle.

Figure 4:
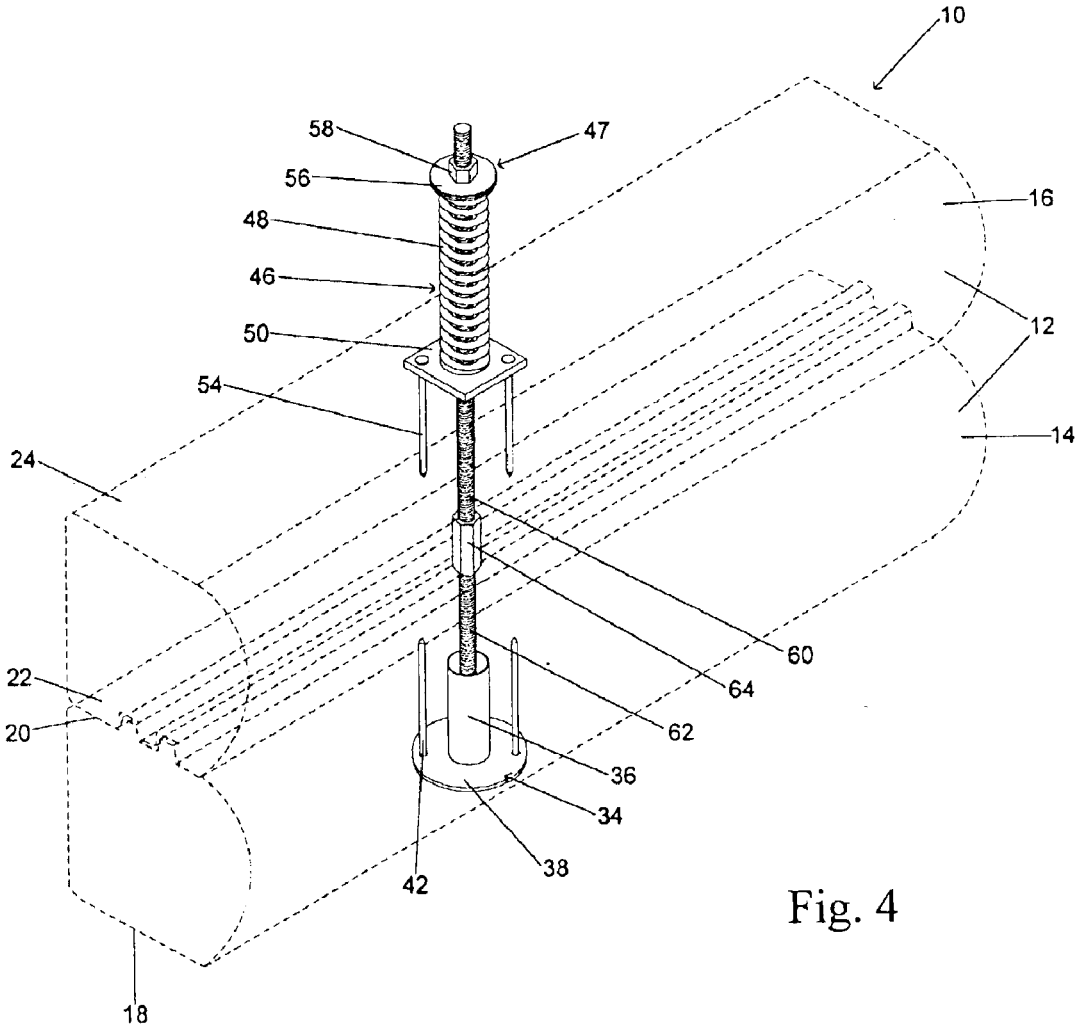
FIG. 4 is a perspective view of a portion of a wall constructed according to another embodiment of the invention.
Figure 5:
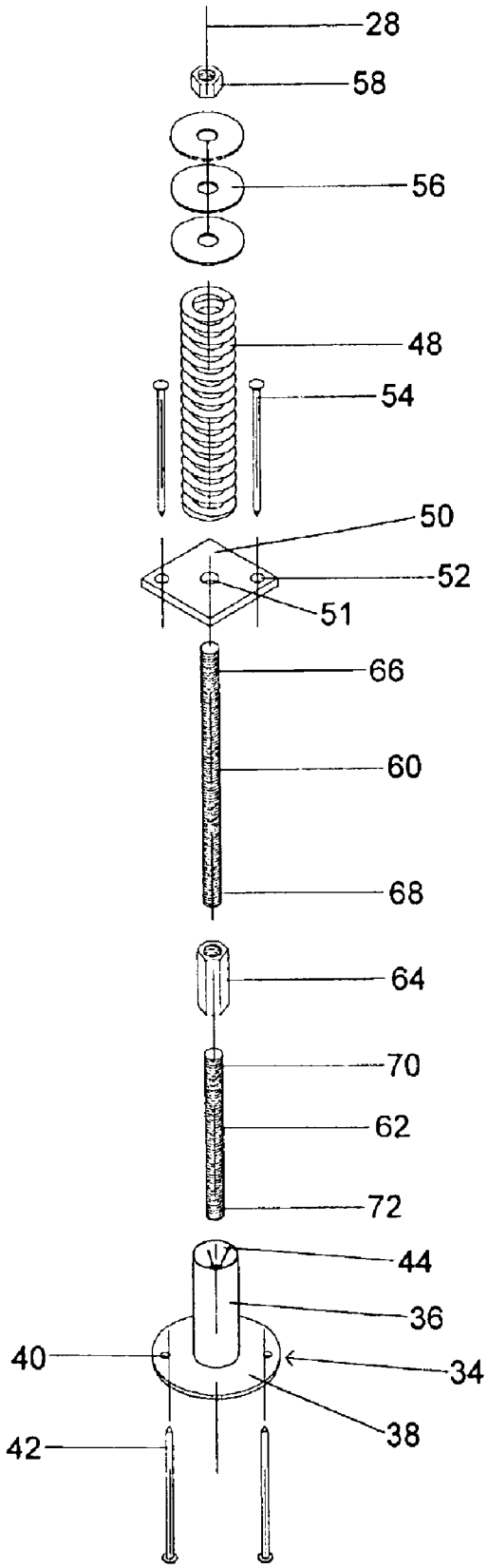
FIG. 5 is an exploded view of a thru-bolt system for constructing walls in accordance with another embodiment of the invention.

With reference to FIGS. 4 and 5, in an alternative embodiment the rod 26 may comprise at least two rod members, such as an upper rod member 60 and a lower rod member 62. This alternative embodiment is particularly useful for higher walls. In this alternative embodiment, the upper rod member 60 and the lower rod member 62 are attached by a coupling 64. The coupling 64 may comprise a nut or other coupling suitable for attaching the two rod members 60 and 62. Although FIGS. 4 and 5 depict only two rod members 60 and 62, it is contemplated that additional rod members may comprise the rod 26 and be joined together by additional couplings 64.

The upper rod member 60 has an upper end 66 in opposed relation to a lower end 68 and the lower rod member 62 has an upper end 70 in opposed relation to a lower end 72. The upper rod member upper end 66 is attached to the upper fastener 47 and the upper rod member lower end 68 is attached to the coupling 64. The lower rod member upper end 70 is also attached to the coupling while the lower rod member lower end 72 is attached to the lower fastener 34. This alternative embodiment allows multiple rod members to be joined to comprise the rod 26 and accommodate varying heights and configurations of the wall 10.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the bottom wall member, the lower fastener comprising a locking nut, the locking nut including an internally threaded portion for receiving a threaded portion of the lower end of the rod, the threaded portion of the locking nut extending substantially along the first axis, and the locking nut including an unthreaded portion approximately one half inch (1.25 cm) long below the first threaded portion, the threaded portion and unthreaded portion of the locking nut extending substantially along the first axis, and a flange extending transversely to the first axis for supporting the threaded portion wherein the flange of the locking nut includes a fastening means attaching the flange to the lower surface of the bottom wall member to secure the lower fastener to the bottom wall member and wherein the threaded portion of the locking nut comprises a tapered surface opening at an end of the threaded portion for receiving the rod to facilitate attachment of the rod to the lower fastener;

an upper fastener attached to the upper end of the rod adjacent the upper surface of the top wall member;

an actuator positioned between the upper fastener and the upper surface of the top wall member for applying a downward force to the top wall member, the actuator comprising a spring;

a spring support plate attached to the upper surface of the top wall member, the spring support plate having an opening for the rod to pass therethrough and the spring support plate having at least one hole for at least one spring support plate fastener, and at least one the spring support plate fastener passing through a hole in the spring support plate thereby attaching the spring support plate to the top wall member.

2. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the bottom wall member, the lower fastener comprising a locking nut, the locking nut including an internally threaded portion for receiving a threaded portion of the lower end of the rod, the threaded portion of the locking nut extending substantially alone the first axis, and a flange extending transversely to the first axis for supporting the threaded portion wherein the flange of the locking nut includes a fastening means attaching the flange to the lower surface of the bottom wall member to secure the lower fastener to the bottom wall member and wherein the threaded portion of the locking nut comprises a tapered surface opening at an end of the threaded portion for receiving the rod to facilitate attachment of the rod to the lower fastener;

an upper fastener attached to the upper end of the rod adjacent the upper surface of the top wall member;

an actuator positioned between the upper fastener and the upper surface of the top wall member for applying a downward force to the top wall member, the actuator comprising a spring;

a spring support plate attached to the upper surface of the top wall member, the spring support plate having an opening for the rod to pass therethrough and the spring support plate having at least one hole for at least one spring support plate fastener, and at least one the spring support plate fastener passing through a hole in the spring support plate thereby attaching the spring support plate to the top wall member.

3. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the bottom wall member, the lower fastener comprising a locking nut, the locking nut including an internally threaded portion for receiving a threaded portion of the lower end of the rod, the threaded portion of the locking nut extending substantially along the first axis, and a flange extending transversely to the first axis for supporting the threaded portion wherein the flange of the locking nut includes a fastening means attaching the flange to the lower surface of the bottom wall member to secure the lower fastener to the bottom wall member and wherein the threaded portion of the locking nut comprises a tapered surface opening at an end of the threaded portion for receiving the rod to facilitate attachment of the rod to the lower fastener;

an upper fastener attached to the upper end of the rod adjacent the upper surface of the top wall member; and an actuator positioned between the upper fastener and the upper surface of the top wall member for applying a downward force to the top wall member, the actuator comprising a spring and a spring support plate, the spring support plate having an opening for the rod to pass therethrough and the spring support plate attached to the upper surface of the top wall member.

4. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the lower surface of the bottom wall member, the lower fastener comprising a locking nut, the locking nut including an internally threaded portion for receiving a threaded portion of the lower end of the rod and an unthreaded portion approximately one half inch (1.25 cm) long below the threaded portion, the threaded portion and unthreaded portion of the locking nut extending substantially along the first axis, and the locking nut including a flange extending transversely to the first axis for supporting the threaded portion wherein the flange of the locking nut includes a fastening means attaching the flange to the lower surface of the bottom wall member thereby securing the lower fastener to the bottom wall member;

an upper fastener attached to the upper end of the rod adjacent the upper surface of the top wall member;

an actuator positioned between the upper fastener and the upper surface of the top wall member for applying a downward force to the top wall member, the actuator comprising a spring;

a spring support plate attached to the upper surface of the top wall member, the spring support plate having an opening for the rod to pass therethrough and the spring support plate having at least one hole for at least one spring support plate fastener, and at least one the spring support plate fastener passing through a hole in the spring support plate thereby attaching the spring support plate to the top wall member.

5. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the lower surface of the bottom wall member, the lower fastener comprising a locking nut, the locking nut including an internally threaded portion for receiving a threaded portion of the lower end of the rod and an unthreaded portion approximately one half inch (1.25 cm) long below the threaded portion, the threaded portion and unthreaded portion of the locking nut extending substantially along the first axis, and the locking nut including a flange extending transversely to the first axis for supporting the threaded portion wherein the flange of the locking nut includes a fastening means attaching the flange to the lower surface of the bottom wall member thereby securing the lower fastener to the bottom wall member;

an upper fastener attached to the upper end of the rod adjacent the upper surface of the top wall member;

an actuator positioned between the upper fastener and the upper surface of the top wall member for applying a downward force to the top wall member, the actuator comprising a spring and a spring support plate, the spring support plate having an opening for the rod to pass therethrough and the spring support plate attached to the upper surface of the top wall member.

6. A wall comprising:

a plurality of wall members stacked substantially vertically and including a bottom wall member and a top wall member, each of said wall members including an upper surface in opposed relation to a lower surface and a through opening extending from the upper surface to the lower surface, wherein a through opening in each wall member is aligned with a through opening in all other wall members so as to form a through opening in the wall extending from the upper surface of the top wall member to the lower surface of the bottom wall member;

a rod positioned in the through opening of the wall and having an upper end in opposed relation to a lower end, the rod extending along a first axis;

a lower fastener attached to the lower end of the rod and attached to the lower surface of the bottom wall member, the lower fastener comprising a locking nut, the locking nut including an internally threaded portion for receiving a threaded portion of the lower end of the rod, the threaded portion of the locking nut extending substantially along the first axis and a tapered surface opening at an end of the threaded portion for receiving the rod to facilitate attachment of the rod to the lower fastener, and a flange extending transversely to the first axis for supporting the threaded portion wherein the flange of the locking nut includes a fastening means attaching the flange to the lower surface of the bottom wall member to secure the lower fastener to the bottom wall member;

a spring support plate attached to the upper surface of the top wall member, the spring support plate having an opening for the rod to pass therethrough and the spring support plate having at least one hole for at least one spring support plate fastener;

at least one the spring support plate fastener passing through a hole in the spring support plate thereby attaching the spring support plate to the top wall member;

an upper fastener attached to the upper end of the rod adjacent the upper surface of the top wall member and a spring positioned between the upper fastener and the spring support plate for applying a downward force to the top wall member.

7. The wall of claim 6 wherein a shaped recess is formed in the bottom wall member for receiving the flange and preventing rotation of the lower fastener.

8. The wall of claim 6 wherein the rod comprises at least two rod members coupled together to extend along the first axis.

9. The wall of claim 6 wherein the entire length of the rod is threaded.

10. The wall of claim 6 wherein the wall members comprise logs.

11. The wall of claim 6 the upper fastener comprises a washer member, the washer member positioned on the rod above the actuator.

* * * * *